US005186498A

United States Patent [19]

Dietrich

[11] Patent Number: 5,186,498

[45] Date of Patent: Feb. 16, 1993

[54] METHOD FOR IDENTIFYING POSTAGE METER AND MONETARY VALUE STAMPING MACHINES

[75] Inventor: Klaus Dietrich, Berlin, Fed. Rep. of Germany

[73] Assignee: Francotyp-Postalia GmbH, Berlin, Fed. Rep. of Germany

[21] Appl. No.: 647,442

[22] Filed: Jan. 29, 1991

[30] Foreign Application Priority Data

Jan. 30, 1990 [DE] Fed. Rep. of Germany ..... 4003006

[51] Int. Cl.[5] ..... B42D 15/00

[52] U.S. Cl. ..... 283/67; 283/71; 283/903

[58] Field of Search ..... 283/67, 903, 71

[56] References Cited

U.S. PATENT DOCUMENTS 4,725,079 2/1988 Koza et al. ..... 283/903 X

*Primary Examiner*—Paul A. Bell

*Attorney, Agent, or Firm*—Herbert L. Lerner; Laurence A. Greenberg

[57] ABSTRACT

A method for identifying postage meter and monetary value stamping machines from printed patterns thereof includes performing microprocessor-controlled printing processes in the machine for forming a printing pattern including a monetary value stamp, a data stamp and a printing block from stored data and current data only immediately prior to being printed and temporarily storing the printing pattern until being printed. An identification characteristic is imprinted in the open in addition to the pattern to be printed. The temporarily stored printing pattern and the identification characteristic are supplied together to a printer control for generating a final printing pattern.

1 Claim, 1 Drawing Sheet

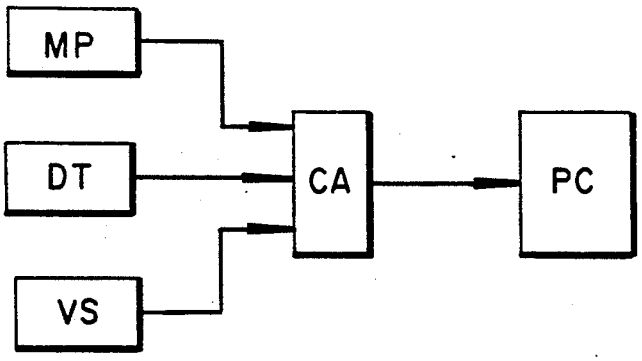
FIG. 1
FIG. 2
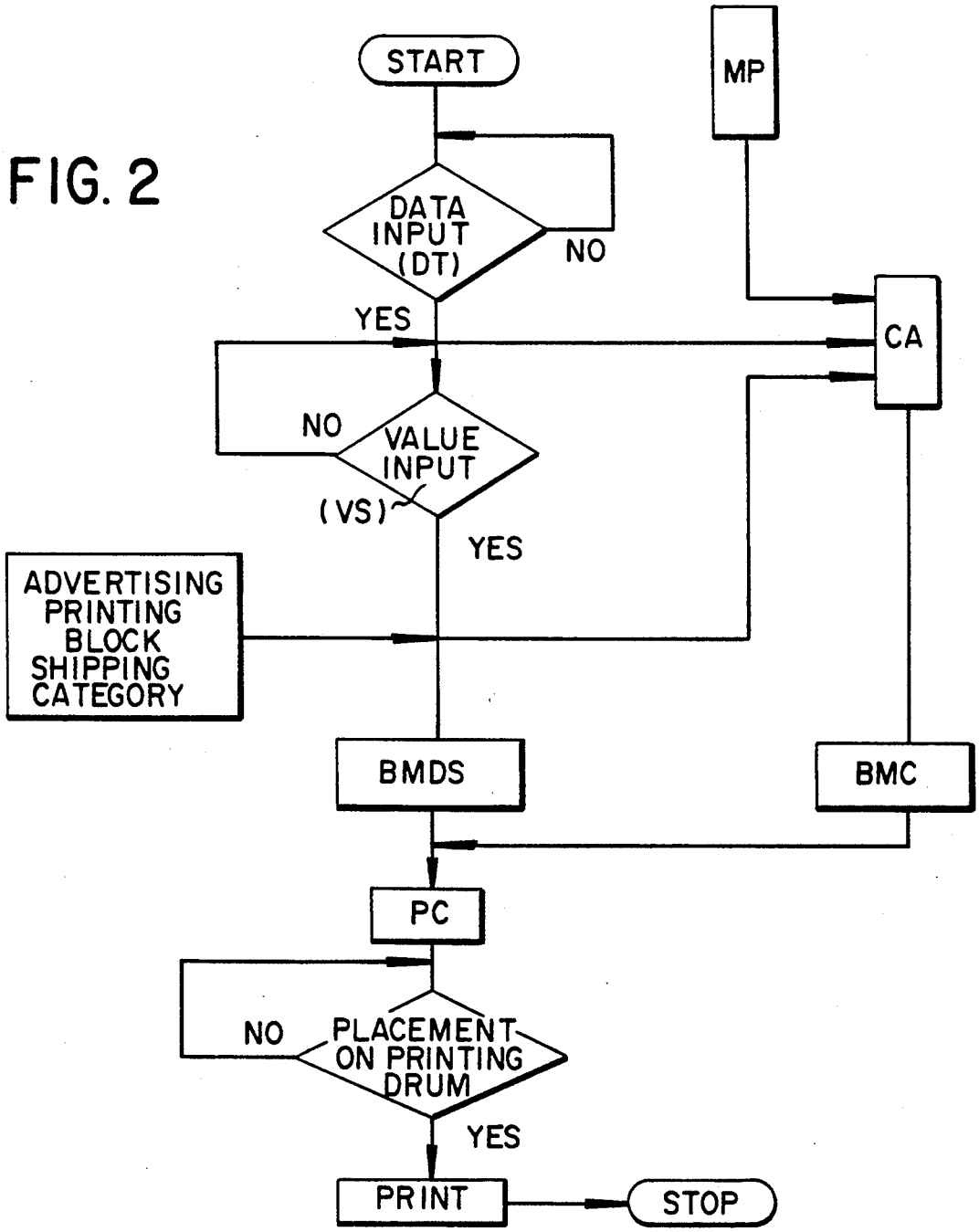

METHOD FOR IDENTIFYING POSTAGE METER AND MONETARY VALUE STAMPING MACHINES

The invention relates to a method for identifying postage meter and monetary value stamping machines from their printed pattern, wherein the machines have microprocessor-controlled printing processes in which the printing pattern is formed from stored data and current data only immediately before being printed and is temporarily stored until being printed.

Postage meter and monetary value stamping machines have printers that print postage or monetary values on items such as material to be mailed, receipts and documents, etc., as proof of fee payment. For many applications it is necessary to be able to identify the machines from the print, for example in order to detect counterfeiting.

In order to avoid such counterfeiting, it is known to incorporate markings in the printing that are not initially visible and that show out only upon being copied, such as in German Published, Non-Prosecuted Application DE-OS 34 19 859. It is also known to use a security paper for the original printing, in which the color density of security markings is below the limit for reproduction, as in German Patent DE-PS 28 05 146.

However, such methods are complicated and cannot always be used if it is required to provide direct printing on various substrates, such as letters or various preprinted accompanying forms. Furthermore, they assure protection against copying, but not against replication by some other machine.

It is accordingly an object of the invention to provide a method for identifying postage meter and monetary value stamping machines, which overcomes the hereinafore-mentioned disadvantages of the heretofore-known methods of this general type, and which uses microprocessor-controlled printing methods, such as laser printing, dot matrix printing, or thermal printing that cannot be counterfeited or in other words cannot be replicated by another machine, in order to assure increased security for bookkeeping purposes.

With the foregoing and other objects in view there is provided, in accordance with the invention, a method for identifying postage meter and monetary value stamping machines from printed patterns thereof, which comprises performing microprocessor-controlled printing processes in the machine for forming a printing pattern including a monetary value stamp, a date stamp and a printing block from stored data and current data only immediately prior to being printed and temporarily storing the printing pattern until being printed, imprinting an identification characteristic in the open or being exposed in addition to the pattern to be printed, and supplying the temporarily stored printing pattern and the identification characteristic together to a printer control for generating a final printing pattern.

In accordance with another mode of the invention, there is provided a method which comprises forming the identification characteristic from parameters of the machine and numerical values of the printed date, the monetary value and the printing block with a cryptographic algorithm, and temporarily storing the identification characteristic in the form of a multiple-place cryptographic number until being printed.

In accordance with a concomitant mode of the invention, there is provided a method which comprises using a factory number of the machine and a number of printing operations of the machine as the machine parameters.

Other features which are considered as characteristic for the invention are set forth in the appended claims.

Although the invention is illustrated and described herein as embodied in a method for identifying postage meter and monetary value stamping machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

FIG. 1 is a diagram showing an overview for producing an identification feature; and FIG. 2 is a flow chart for printing control.

In microprocessor-controlled printing methods in postage meter and monetary value stamping machines, the material to be printed by stamping is produced by microprocessors, memories and registers. The printing pattern or image is not generated until immediately before being printed and it is produced, for instance, from stored data, such as printing block patterns and current data, like the date and the amount of the fee. In addition to such a printing pattern, an identification characteristic is also printed. In order to make the identification characteristic uncounterfeitable, parameters of the particular machine are linked with elements of the fee amount and the date to be printed.

Referring now to the figures of the drawings in detail and first, particularly, to FIG. 1 thereof, there are seen machine parameters MP, such as a serial number or factory number, a number of imprints with a date DT, a value setting WE and optionally numbers of an advertising printing block which, for instance, are linked by means of a cryptographic algorithm KA. An encrypted, multiple-place cryptographic number obtained as a result is additionally incorporated into the printing pattern through a printer control DS.

FIG. 2 shows a flow chart for the assembled imprint including the monetary value, date, printing block print and multiplace cryptographic number. Once the machine has been started, the input of the date and the monetary value, such as the postage, and the imprint of the printing block are supplied to a buffer memory ZWD for the printer control. Parallel thereto, the cryptographic number is formed from the date DT, the monetary value input WE and the machine parameters MP and this number is stored in a buffer memory ZWK. The contents of the buffer memories ZWD, ZWK are supplied to the printer control DS, which produces the final printing pattern.

The printing itself is triggered by the placement of an envelope, postage strip, document, receipt, and so forth on the printing drum of the machine.

This additional open imprint of an encrypted multiplace number, which is different for each imprint, can be decoded only by a monitoring station, which has the same encrypting algorithm available to it. The monitoring station is thus in a position to associate various imprints with the various machines. Neither the machine operator nor anyone else can retrace the cryptographic number, so that this provides additional security for bookkeeping purposes.

I claim:

1. A method for identifying postage meter and monetary value stamping machines from printed patterns thereof, which comprises performing microprocessor-controlled printing processes in the machine for forming a printing pattern including a monetary value stamp, a date stamp and a printing block from stored data and current data, forming an identification characteristic from parameters of the machine, including a factory number of the machine and a number of printing operations of the machine in the machine parameters, and numerical values of the printed date, the monetary value and the printing block with a cryptographic algorithm, and temporarily storing the identification characteristic in the form of a multiple-place cryptographic number until being printed, imprinting the identification characteristic in the open in addition to the pattern to be printed, and supplying the temporarily stored printing pattern and the identification characteristic together to a printer control for generating a final printing pattern.

* * * * *